US008250897B2

(12) United States Patent
Nishigori et al.

(10) Patent No.: US 8,250,897 B2
(45) Date of Patent: Aug. 28, 2012

(54) HIGH STRENGTH WORKPIECE MATERIAL AND METHOD AND APPARATUS FOR PRODUCING THE SAME

(75) Inventors: Shigeru Nishigori, Yasu (JP); Toru Akita, Kusatsu (JP); Yoshinori Goho, Otsu (JP); Katsuyoshi Kondoh, Minoh (JP)

(73) Assignee: Gohsyu Co., Ltd., Shiga (JP)

( * ) Notice: Subject to any disclaimer, the term of this patent is extended or adjusted under 35 U.S.C. 154(b) by 616 days.

(21) Appl. No.: 12/311,558

(22) PCT Filed: Oct. 3, 2007

(86) PCT No.: PCT/JP2007/069344

§ 371 (c)(1),
(2), (4) Date: Apr. 3, 2009

(87) PCT Pub. No.: WO2008/044564

PCT Pub. Date: Apr. 17, 2008

(65) Prior Publication Data

US 2010/0024512 A1 Feb. 4, 2010

(30) Foreign Application Priority Data

Oct. 5, 2006 (JP) ..... 2006-273686

(51) Int. Cl.
*B21J 13/00* (2006.01)
*B21J 5/00* (2006.01)

(52) U.S. Cl. ..... 72/355.4; 72/353.2; 72/355.6

(58) Field of Classification Search ..... 72/267, 72/353, 353.2, 354.6, 355.2, 355.4, 355.6, 72/358

See application file for complete search history.

(56) References Cited

U.S. PATENT DOCUMENTS

| | | | | | |
|---|---|---|---|---|---|
| 2,921,875 | A | * | 1/1960 | Schnitzel et al. | 148/514 |
| 3,283,556 | A | * | 11/1966 | Putetti et al. | 72/343 |
| 3,745,623 | A | * | 7/1973 | Wentorf et al. | 407/119 |
| 3,899,821 | A | * | 8/1975 | Ito et al. | 419/28 |
| 4,142,888 | A | * | 3/1979 | Rozmus | 419/49 |
| 4,177,665 | A | * | 12/1979 | Schurmann | 72/359 |
| 4,636,253 | A | * | 1/1987 | Nakai et al. | 75/239 |
| 4,861,546 | A | * | 8/1989 | Friedman | 419/8 |
| 5,218,853 | A | * | 6/1993 | Mueller et al. | 72/325 |
| 6,332,905 | B1 | * | 12/2001 | Ootaguchi et al. | 75/245 |

(Continued)

FOREIGN PATENT DOCUMENTS

JP 55-120412 9/1980

(Continued)

*Primary Examiner* — Edward Tolan
*Assistant Examiner* — Homer Boyer
(74) *Attorney, Agent, or Firm* — Clark & Brody

(57) ABSTRACT

A method for producing a high strength workpiece material includes the steps of: placing an alloy material 10 into a central space of a cylindrical mold 2; vertically compressing both end faces of the material in the central space with a press member 5 and a first support member 3, thereby causing one lengthwise end of the material to flow radially outward along an end face of the cylindrical mold 2 to form an expanded part; bringing the press member 5 into contact with a lengthwise end face of the expanded part so as to press the expanded part against the end face of the cylindrical mold 2; and increasing the distance between the press member 5 and the end face of the cylindrical mold 2 while decreasing the distance between the press member 5 and the first support member 3, thereby continuously causing the radially outward flow from one end to another end of the material to gradually increase the thickness of the expanded part.

13 Claims, 18 Drawing Sheets

U.S. PATENT DOCUMENTS

| | | | | |
|---|---|---|---|---|
| 6,357,274 | B1 * | 3/2002 | Tanaka et al. | 72/356 |
| 7,013,696 | B2 * | 3/2006 | Ando et al. | 72/355.6 |
| 7,377,042 | B2 * | 5/2008 | Krintzline et al. | 29/898.068 |
| 2008/0015683 | A1 * | 1/2008 | Kramer-Brown et al. | 623/1.15 |
| 2010/0223856 | A1 * | 9/2010 | Davies et al. | 51/307 |

FOREIGN PATENT DOCUMENTS

| | | |
|---|---|---|
| JP | 8-3675 | 1/1996 |
| JP | 11-114618 | 4/1999 |
| JP | 2000-303102 | 10/2000 |
| JP | 2000-313948 | 11/2000 |
| JP | 2002-224792 | 8/2002 |
| JP | 2003-96531 | 4/2003 |
| JP | 2003-313646 | 11/2003 |
| JP | 2006-152401 | 6/2006 |
| RU | 2 189 883 | 9/2002 |
| WO | 01/77398 | 10/2001 |
| WO | 2005/011893 | 2/2005 |

* cited by examiner

GRAIN SIZE: 150-200 μm

GRAIN SIZE :5-7μm

GRAIN SIZE :150 - 200μm

GRAIN SIZE :5 - 30μm

GRAIN SIZE : 1μm or less

GRAIN SIZE : 2 - 4μm

GRAIN SIZE : 2 - 5μm

GRAIN SIZE : 2 - 4μm

HIGH STRENGTH WORKPIECE MATERIAL AND METHOD AND APPARATUS FOR PRODUCING THE SAME

TECHNICAL FIELD

The present invention generally relates to a high strength workpiece material used as a metal workpiece material, and a method and an apparatus for producing the same. More particularly, the present invention relates to production of a large-diameter billet having a high strength, fine crystal structure by processing a long body having a small cross-sectional shape into a short body having a large cross-sectional shape by plastic working.

BACKGROUND ART

In order to produce a relatively large product by plastic-working a metal or alloy workpiece material, it is necessary to increase the size of the workpiece material before plastic working.

A casting method has been a mainstream method for producing a large material from a light alloy such as a magnesium alloy and an aluminum alloy. However, a workpiece material produced by the casting method has a coarse crystal structure and a low strength. Accordingly, a product obtained by forging a workpiece material produced by the casting method does not have a satisfactory strength.

An example of a method for producing a billet-shaped workpiece material is a method for forging a bar-shaped body into a large-diameter body by a swaging machine. For example, Japanese Patent Publication No. H08-3675 of unexamined applications discloses forging of an aluminum alloy at a swaging ratio of 10 to 50%. Japanese Patent Publication No. 2006-152401 of unexamined applications discloses production of a magnesium alloy molded body by forging a high Al content magnesium alloy material.

In order to perform swaging normally without causing buckling of a material and the like, the ratio L/D of the length (L) to the diameter (D) of a material before swaging is 2 or less. Since the material is only slightly plastically deformed by a swaging process, the crystal structure of the material does not become so fine and the strength of the material is not improved sufficiently.

Extruding a cast product makes the crystal structure fine, whereby the extruded material has a high strength. For example, Japanese Patent Publication No. 2003-313646 discloses extrusion of an Mg—Mn-based alloy to obtain fine crystal grains and a high strength.

In an extrusion process, the strength increases as the extrusion ratio rises. In order to obtain a desired high strength by the extrusion process, the extrusion ratio (the ratio of the cross-sectional area of a material before the extrusion process to the cross-sectional area of the material after the extrusion process) needs to be, for example, 25 or more.

For example, in order to obtain a large billet of 150 mm in diameter by the extrusion process with an extrusion ratio of 25, a material before the extrusion process needs to have a diameter of 750 mm. In this case, the press capability of as high as 12,000 to 18,000 tons is required empirically, although it depends on the kind of the material. However, it is practically impossible to implement such high press capability. It has been difficult to obtain a large material with a high strength and a large diameter by the extrusion process.

When powder is used as a starting material, a billet may be produced as a workpiece material by compacting and solidifying the powder and extruding the resultant powder compact. In this case as well, the extrusion process has the same problems as those described above.

It has been difficult to produce a high strength workpiece material (billet) having a fine crystal structure while having a large diameter by any conventional methods.

DISCLOSURE OF THE INVENTION

It is an object of the present invention to produce a high strength workpiece material having a fine crystal structure while having a large diameter.

A method for producing a high strength workpiece material according to the present invention includes the following steps:

(a) placing a metal or alloy material into a central space of a cylindrical mold;

(b) vertically compressing both end faces of the material in the central space with a first press member and a support member, thereby causing one lengthwise end of the material to flow radially outward along an end face of the cylindrical mold to form an expanded part;

(c) bringing a second press member into contact with a lengthwise end face of the expanded part so as to press the expanded part against the end face of the cylindrical mold; and (d) increasing a distance between the second press member and the end face of the cylindrical mold while decreasing a distance between the first press member and the support member, thereby continuously causing the radially outward flow from one end to another end of the material to gradually increase a thickness of the expanded part.

According to the present invention including the above steps, the radially outward flow is continuously caused from one end to another end of the material to gradually increase the thickness of the expanded part. A large diameter, short body or billet can therefore be easily produced as a final workpiece material by using a small diameter, long body as a starting material. Moreover, since the material is plastic-worked by sequentially partially compressing the material from above and beneath to cause the material to flow radially outward, a final workpiece material has a fine crystal structure.

In one embodiment, the first press member and the second press member are integrally advanced and the cylindrical mold is retracted by an amount larger than the advancement amount of the press members. In another embodiment, the first press member and the second press member may be provided as separate members so as to operate separately.

In the plastic working in which the material is vertically compressed to cause the radially outward flow of the material, a final workpiece material has a fountain-like, radially outward material flow structure appearing from a central region. The final workpiece material therefore has a fine crystal structure in its outer peripheral region, but does not have a very fine crystal structure in the central region. In order to obtain a fine crystal structure in the central region of the workpiece material and thus increase the strength, only a central region of the workpiece material may be vertically compressed to form a recess after the diameter of the material is increased by the radially outward flow.

As another method of obtaining a fine crystal structure in the central region of the workpiece material and thus increase the strength, only the central region of the material may be vertically compressed to form a recess before the plastic working of increasing the thickness of the expanded part. As still another method, the low strength central region of the material may be removed by machining after the thickness of the expanded part is increased.

The material may be an ingot or a powder compact produced by compacting and solidifying powder.

In the case where the powder compact is used as a starting material, a fine powder compact may be disposed on the support member side and a coarse powder compact may be disposed on the first press member side. With this arrangement, the coarse powder compact reliably flows radially outward, whereby a final workpiece material entirely has a fine structure.

In one embodiment, a first material may be disposed on the support member side and a second material of a different kind from that of the first material may be disposed on the first press member side. With this arrangement, different kinds of metals can be desirably bonded together by the plastic flow of the material.

The starting material is, for example, a light alloy such as a magnesium alloy or an aluminum alloy.

A production apparatus for performing the above production method includes: a cylindrical mold having a vertically extending central opening for receiving a metal or alloy material; a support member for supporting the material in the central opening from one end side; a first press member for pressing the material in the central opening from another end side; a second press member for pressing from another end side an expanded part of the material which is expanded radially outward along an end face of the cylindrical mold when the material is pressed by the first press member; and distance control means for increasing a distance between the second press member and the cylindrical mold while decreasing a distance between the first press member and the support member. In one embodiment, the first press member and the second press member are provided integrally. For example, the first press member has a protrusion for forming a recess in a central region of the material.

A high strength workpiece material produced by the above production method is made of a metal or an alloy and has a fountain-like, radially outward material flow structure appearing from a central region.

BEST MODE FOR CARRYING OUT THE INVENTION

Hereinafter, an embodiment of the present invention will be described with reference to the accompanying drawings. The type of a metal or an alloy that is to be plastic-worked by a method and an apparatus of the present invention is not specifically limited, but preferred examples are light alloys such as a magnesium alloy and an aluminum alloy. The present invention is made to obtain a high strength workpiece material having a fine crystal structure while having a relatively large diameter or transverse sectional area. The high strength workpiece material can be formed into a desired product shape by plastic working such as forging.

Figure 1:
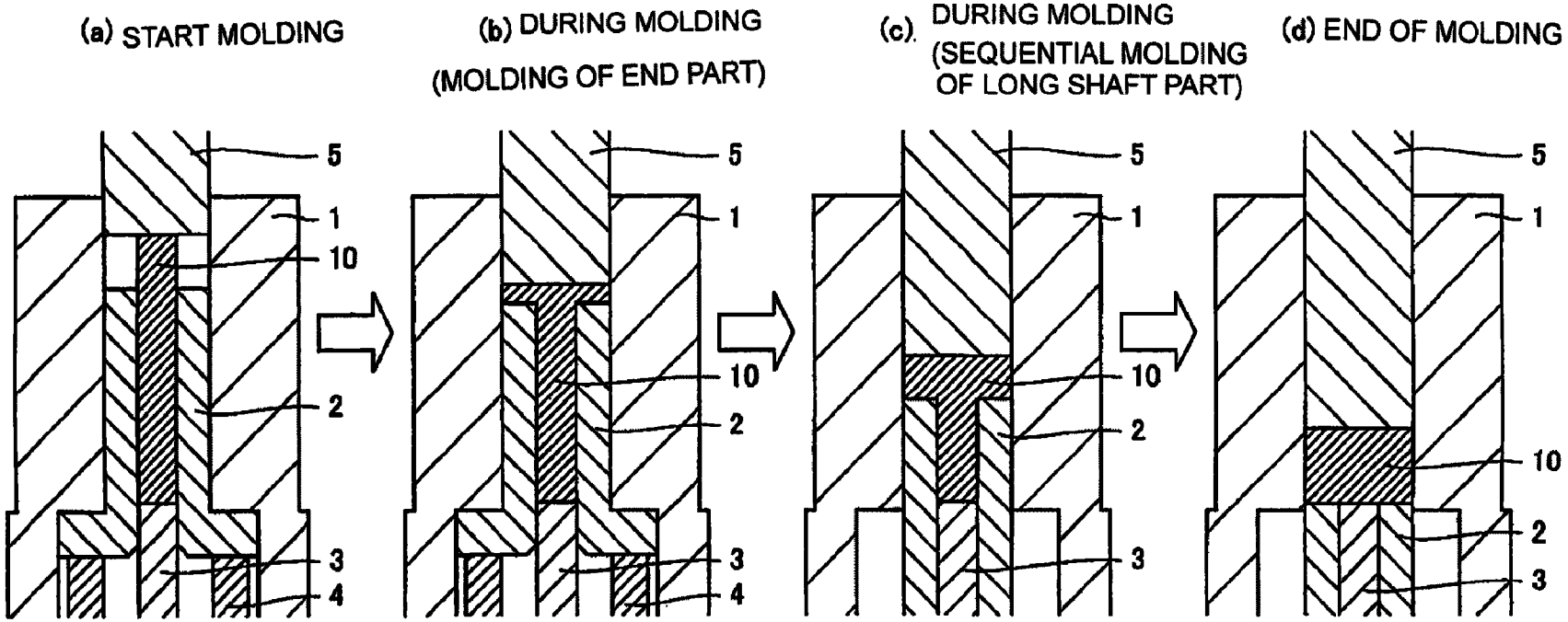
FIG. 1 illustrates a new swaging method according to an embodiment of the present invention.

FIG. 1 shows a method and an apparatus for producing a high strength workpiece material according to an embodiment of the present invention. The apparatus for producing the high strength workpiece material has a fixed mold 1 having a vertically extending central opening, a cylindrical mold 2 that is received in the central opening of the fixed mold 1 in a vertically movable manner, a first support member 3, a second support member 4, and a press member 5.

The cylindrical mold 2 has a vertically extending central opening for receiving a metal or alloy material 10. The first support member 3 supports the material 10 in the central opening of the cylindrical mold 2 from one end side (from the lower end side in the illustrated embodiment) while applying a back pressure. The second support member 4 supports one end face (the lower end face in the illustrated embodiment) of the cylindrical mold 2 while applying a back pressure. The press member 5 presses the material 10 in the central opening of the cylindrical mold 2 from the other end side to vertically compress the material 10 so that the material 10 expands radially outward along the other end face of the cylindrical mold 2. In the illustrated embodiment, the press member 5 is large enough to press also the expanded part of the material 10. In another embodiment, however, a first press member for pressing a material part located in the central opening of the cylindrical mold 2 and a second press member for pressing an expanded part of the material which is pressed by the first press member and thereby expanded radially outward along the end face of the cylindrical mold 2 may be provided separately so as to operate separately.

The first support member 3 and the press member 5 are moved toward each other to vertically compress the material 10 in the central opening of the cylindrical mold 2. In the illustrated embodiment, the first support member 3 is held in a stationary position and the press member 5 moves downward.

The second support member 5 for supporting one end face of the cylindrical mold 2 while applying a back pressure is movable in a vertical direction. The cylindrical mold 2 is moved in the vertical direction with the vertical movement of the second support member 4. The upper end face of the cylindrical mold 2 and the press member 5 apply a pressing force to the radially expanded part of the material 10.

Movement of the first support member 3, the second support member 4, and the press member 5 is controlled so as to implement the following operation: the apparatus for producing the high strength workpiece material includes distance control means for gradually increasing the distance between the press member 5 and the upper end face of the cylindrical mold 2 while gradually reducing the distance between the press member 5 and the first support member 3 during plastic working of the starting material 10.

Hereinafter, the method for producing the high strength workpiece material according to the embodiment of the present invention will be described with reference to FIGS. 1(*a*) to 1(*d*).

In the state of FIG. 1(*a*), the starting material 10 is received in the central opening of the cylindrical mold 2. The upper end of the starting material 10 protrudes upward from the upper end face of the cylindrical mold 2. A ring-shaped gap is thus formed between the upper end face of the cylindrical mold 2 and the press member 5.

The press member 5 is then moved downward from the state of FIG. 1(*a*) to compress the upper end of the material 10, whereby the upper end of the material 10 is expanded radially outward between the upper end face of the cylindrical mold 2 and the press member 5, as shown in FIG. 1(*b*). Movement of the cylindrical mold 2 is controlled so that the cylindrical mold 2 continuously applies a back pressure to the expanded part of the material 10.

FIG. 1(*c*) shows a state during processing. The distance control means gradually increases the lowering speed of the second support member 4 and the cylindrical mold 2 with respect to the lowering speed of the press member 5. As a result, the distance between the press member 5 and the first support member 3 is gradually reduced, while the distance between the press member 5 and the upper end face of the cylindrical mold 2 is gradually increased. More specifically, the expanded part of the material 10 is subjected to a downward pressing force from the press member 5 and an upward back pressure from the cylindrical mold 2. The cylindrical mold 2 moves downward more than the press member 5 does due to the difference between the downward pressing force and the upward back pressure. Since the cylindrical mold 2 moves downward more than the press member 5 does, a gap is formed on the upper end face of the cylindrical member 2, and the material compressed by the press member 5 flows radially outward into the gap. This radially outward flow of the material 10 is caused continuously from the upper end to the lower end of the material 10. The thickness of the expanded part of the material 10 is therefore gradually increased, and a large diameter, short billet is finally obtained as shown in FIG. 1(*d*). In this plastic working, the material 10 is sequentially partially compressed from above and beneath to flow radially outward. The final workpiece material thus obtained has a fine crystal structure and a higher strength.

Figure 2:
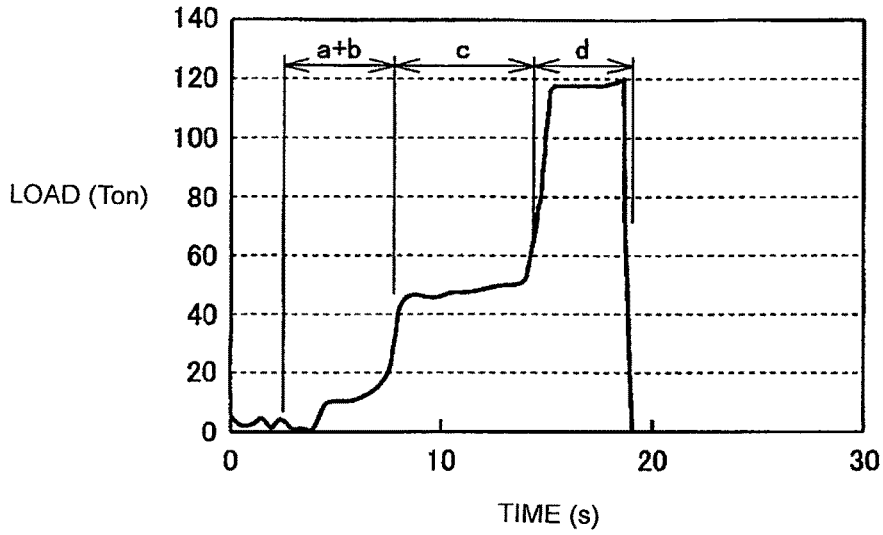
FIG. 2 is a graph showing a load curve of the new swaging method.

FIG. 2 shows a load curve of the new swaging method shown in FIG. 1. The abscissa indicates time and the ordinate indicates the load that is applied to the material. Since the values of the time and the load vary depending on the kind, size, and the like of the starting material, it should be understood that the values shown in the graph are given by way of example only. In the figure, a, b, c, and d correspond to the steps (a), (b), (c), and (d) of FIG. 1, respectively. In the early stage (a) of the process, the load curve rises abruptly when the upper end of the starting material 10 is compressed by the press member 5. The load curve then stays approximately at the same level until the expanded part of the material 10 fills an initial gap between the upper end face of the cylindrical mold 2 and the press member 5. The load curve rises abruptly again when the expanded part of the material 10 starts receiving the back pressure from the cylindrical mold 2 after filling the initial gap. The load curve stays approximately at the same level while the cylindrical mold 2 is moving downward (c). The load curves rises abruptly as soon as the cylindrical mold 2 stopped moving downward in the final stage (d).

In the above plastic working, the material is compressed vertically and the deformed part of the material is caused to gradually plastically flow radially outward to form an expanded part, and the thickness of the expanded part is gradually increased. According to this plastic working, a large-diameter short body can be produced from a small-diameter long body with relatively small press capability. Moreover, the material has a fine crystal structure due to the pressing force applied from above and beneath and the radially outward plastic flow. If warm plastic working is performed, the resultant material has a finer crystal structure due to dynamic recrystallization.

Figure 3:
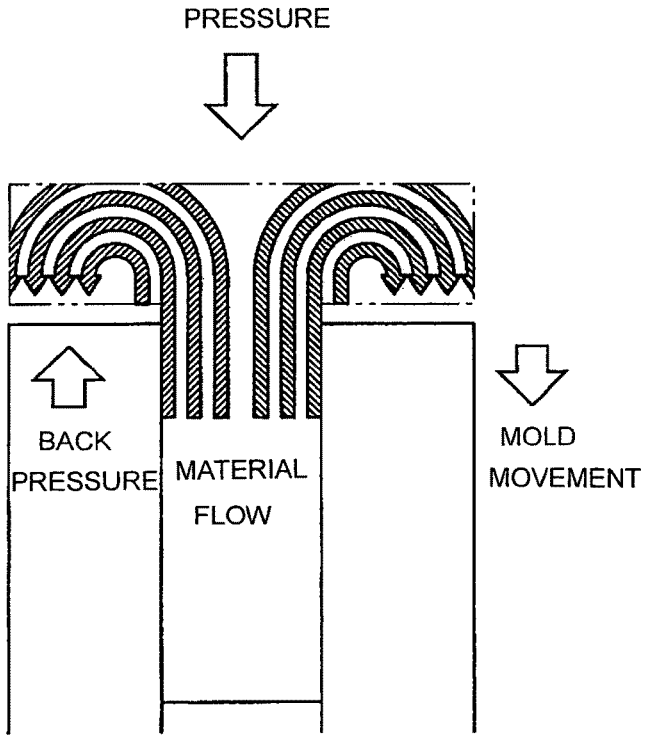
FIG. 3 illustrates a material flow in the new swaging method.
Figure 4:
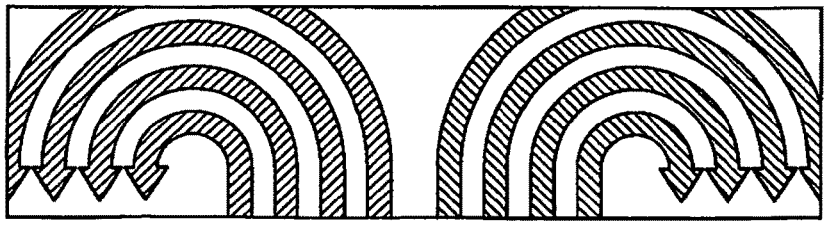
FIG. 4 illustrates a material flow in a final workpiece material produced by the new swaging method.

FIG. 3 illustrates a material flow in the above new swaging method. As shown in the figure, the material flows radially outward from the central region like a fountain in this plastic working method. A final workpiece material therefore has a fountain-like, radially outward material flow structure appearing from the central region, as shown in FIG. 4. Due to such a material flow (plastic flow), the final billet-like workpiece material has a fine crystal structure in its outer peripheral region, but does not have a very fine crystal structure in the central region. Various processes may therefore be performed in order to obtain a fine crystal structure in the central region and thus increase the strength. This will be described later with reference to the drawings.

Figure 16:
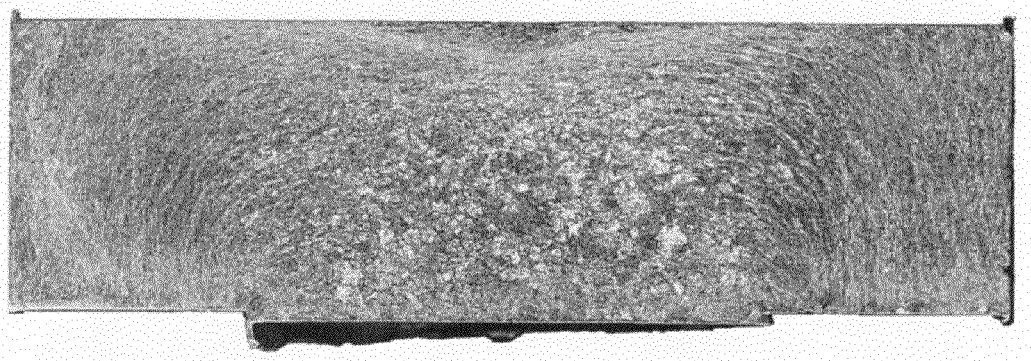
FIG. 16 is an image of a macrostructure of the extruded material.
Figure 21:
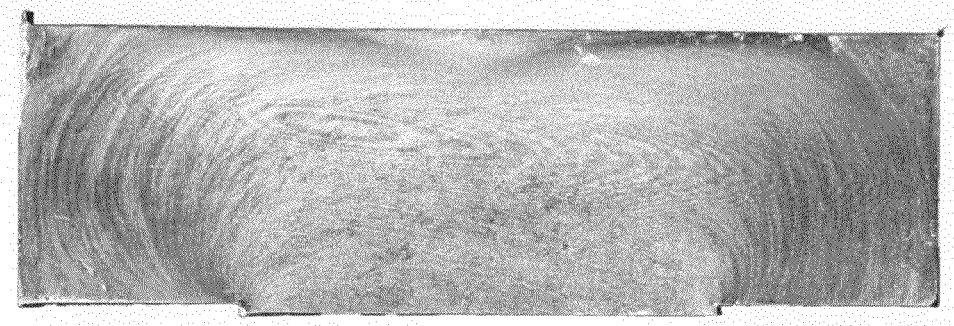
FIG. 21 is an image of a macrostructure of a swaged material.

FIG. 16 is an image of a macrostructure of a workpiece material obtained by plastic-working a magnesium alloy (AZ31) ingot by the new swaging method of FIG. 1. FIG. 21 is an image of a macrostructure of a workpiece material obtained by plastic-working a magnesium alloy (AZ31) powder compact by the new swaging method of FIG. 1. A fountain-like, radially outward material flow structure appearing from the central region can be observed in these figures.

Hereinafter, various methods for obtaining a fine crystal structure in the central region of the workpiece material and increasing the strength of the workpiece material will be described.

Figure 5:
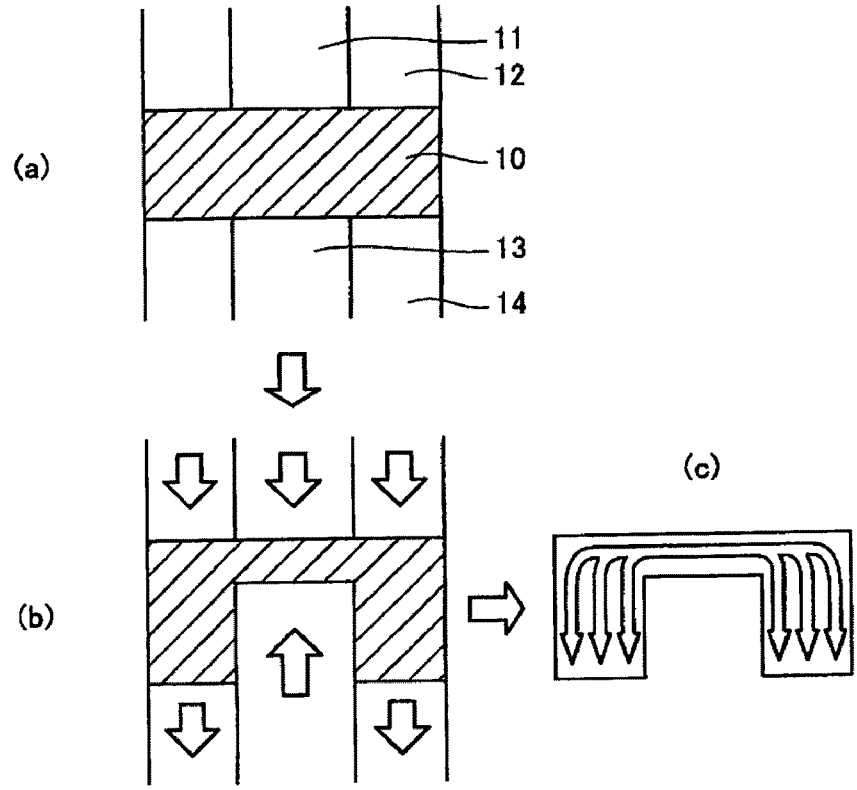
FIG. 5 shows an example of a method for plastic-deforming a central region of a material in a final stage of the new swaging method.

FIG. 5(*a*) shows a state in the final stage of the new swaging method. In the illustrated embodiment, a first support member 13 supports the central part of the workpiece material 10 from beneath, and a cylindrical mold 14 supports the outer peripheral region of the workpiece material 10 from beneath. A first press member 11 presses the central region of the material 10, and a second press member 12 presses the outer periphery of the material 10 formed by radially outward expansion of the material 10. From the swaging completion state shown in FIG. 5(*a*), the first support member 13 is moved upward as shown in FIG. 5(*b*) to compress the central region of the material 10 and thereby move the material in the central region to the outer peripheral region. The cylindrical mold 14 is moved downward by the expanded part of the material moved to the outer peripheral region. As a result of this plastic deformation, the workpiece material 10 has fine crystal grains in the central region and has an increased strength.

Figure 6:
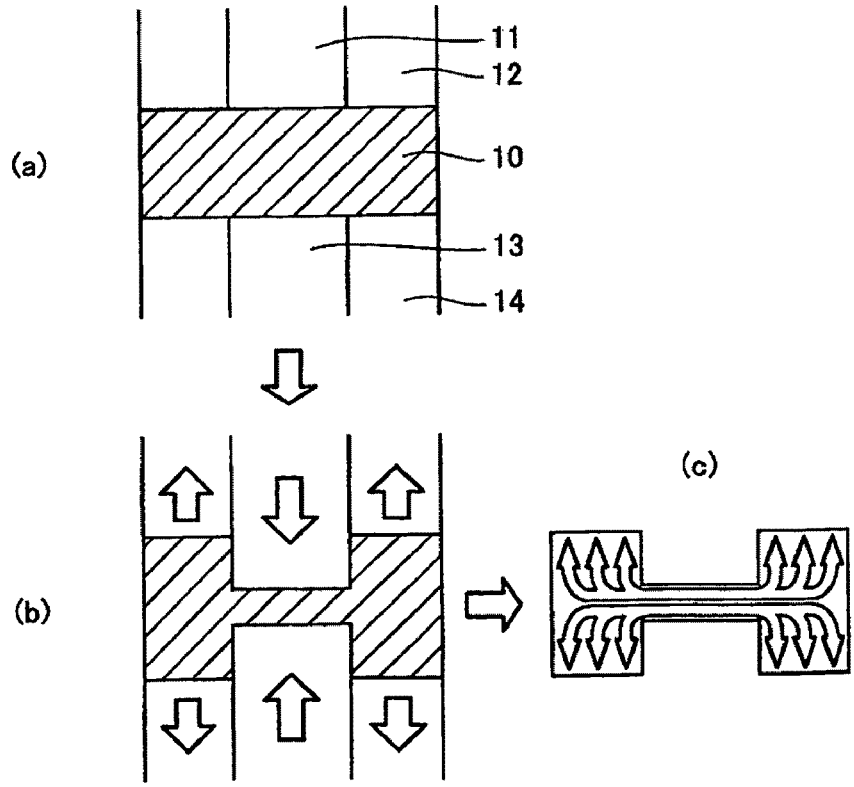
FIG. 6 shows another example of the method for plastic-deforming a central region of a material in a final stage of the new swaging method.

In the method of FIG. 6, the first press member 11 is moved downward and the first support member 13 is moved upward as shown in FIG. 6(*b*) from the swaging completion state of FIG. 6(*a*) in order to compressively deform the central region of the material 10 from above and beneath. By the compression deformation of the central region, the material in the central region moves to the outer peripheral region, whereby the second press member 12 moves upward and the cylindrical mold 14 moves downward accordingly. As a result of this plastic deformation, the workpiece material 10 has fine crystal grains in the central region and has an increased strength.

Figure 7:
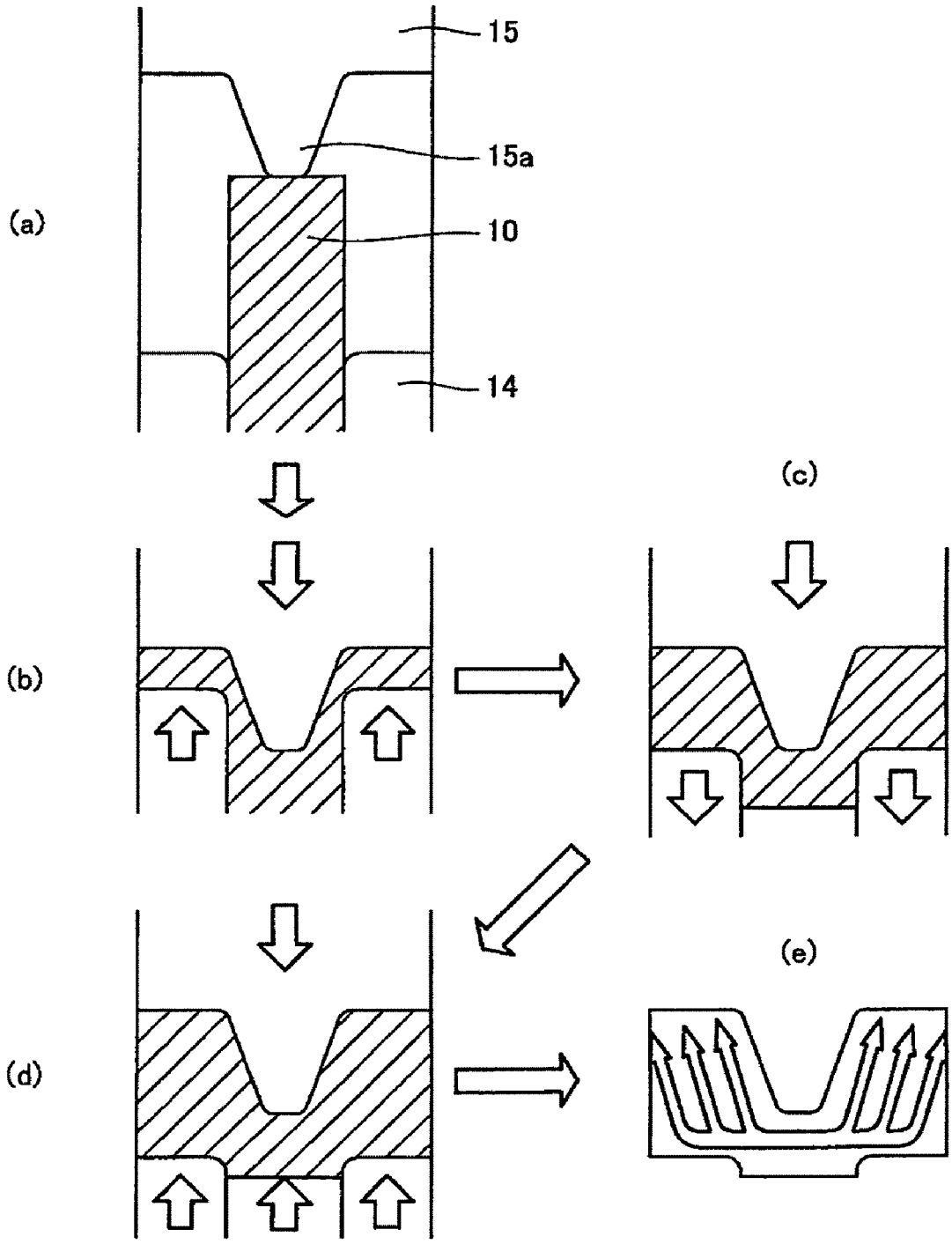
FIG. 7 shows an example of a method for plastic-deforming a central region of a material in an early stage of the new swaging method.

In the method of FIG. 7, the central region of the material 10 is compressively deformed at the beginning of the new swaging method. As shown in FIG. 7(*a*), a press member 15 has a protrusion 15*a* for forming a recess in the central region of the material 10. A recess is first formed in the central region of the material 10 to reduce the thickness of the central region, and the material 10 is then caused to flow radially outward. In this case, the volume in the central region having a low strength is reduced, whereby the overall strength of the material 10 is improved.

Figure 8:
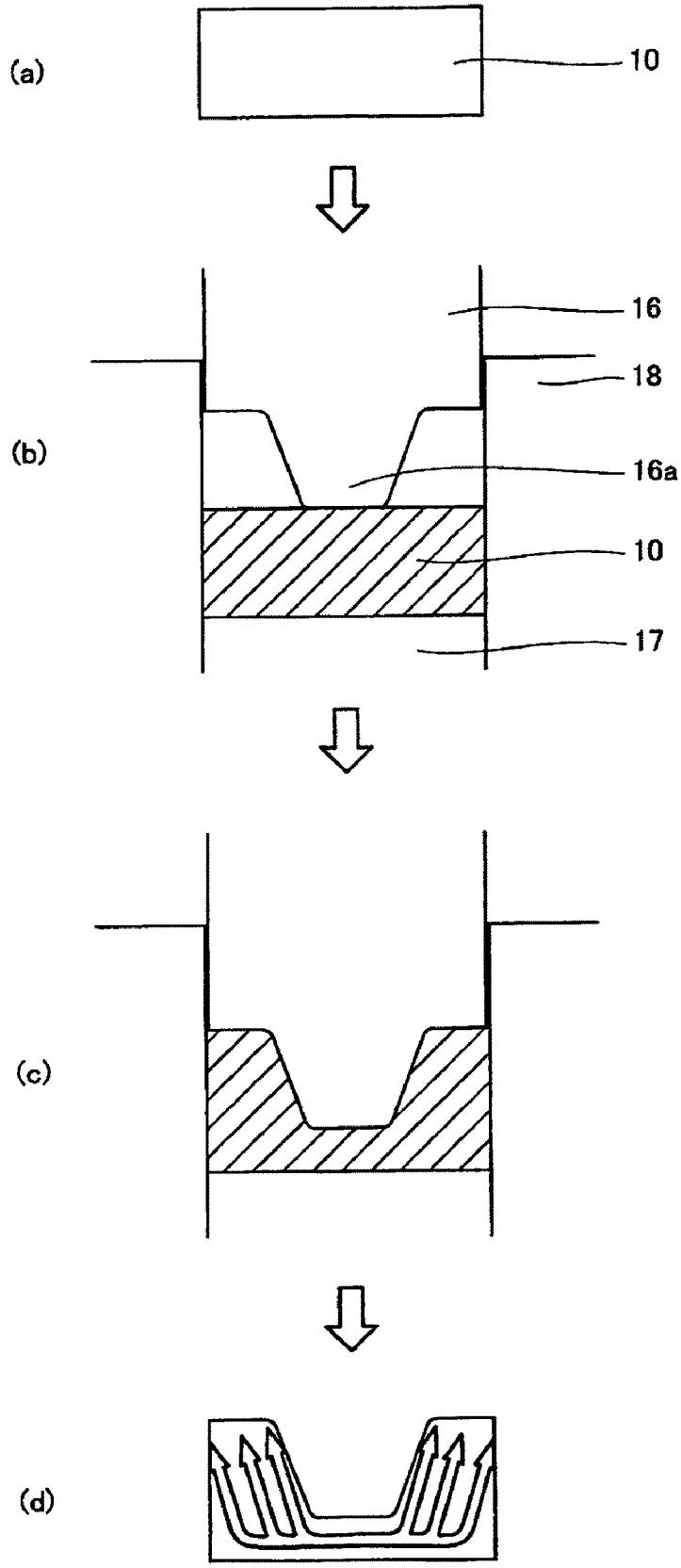
FIG. 8 shows an example of a method for plastic-deforming a central region of a material after completion of the new swaging method by forging.

FIG. 8 shows a method for forging a billet 10 after completion of the new swaging method. A forging apparatus includes a fixed mold 18 having a central opening for receiving the billet 10, a lower base 17 for supporting the billet 10 from beneath, and an upper punch 16 having a protrusion 16*a* for forming a recess in the central region of the billet 10. As shown in FIGS. 8(*c*) and 8(*d*), when a recess is formed in the central region of the billet 10 by compression with the upper punch 16 having the protrusion 16*a*, the material in the central region moves to the outer peripheral region, whereby the overall strength is increased.

Figure 9:
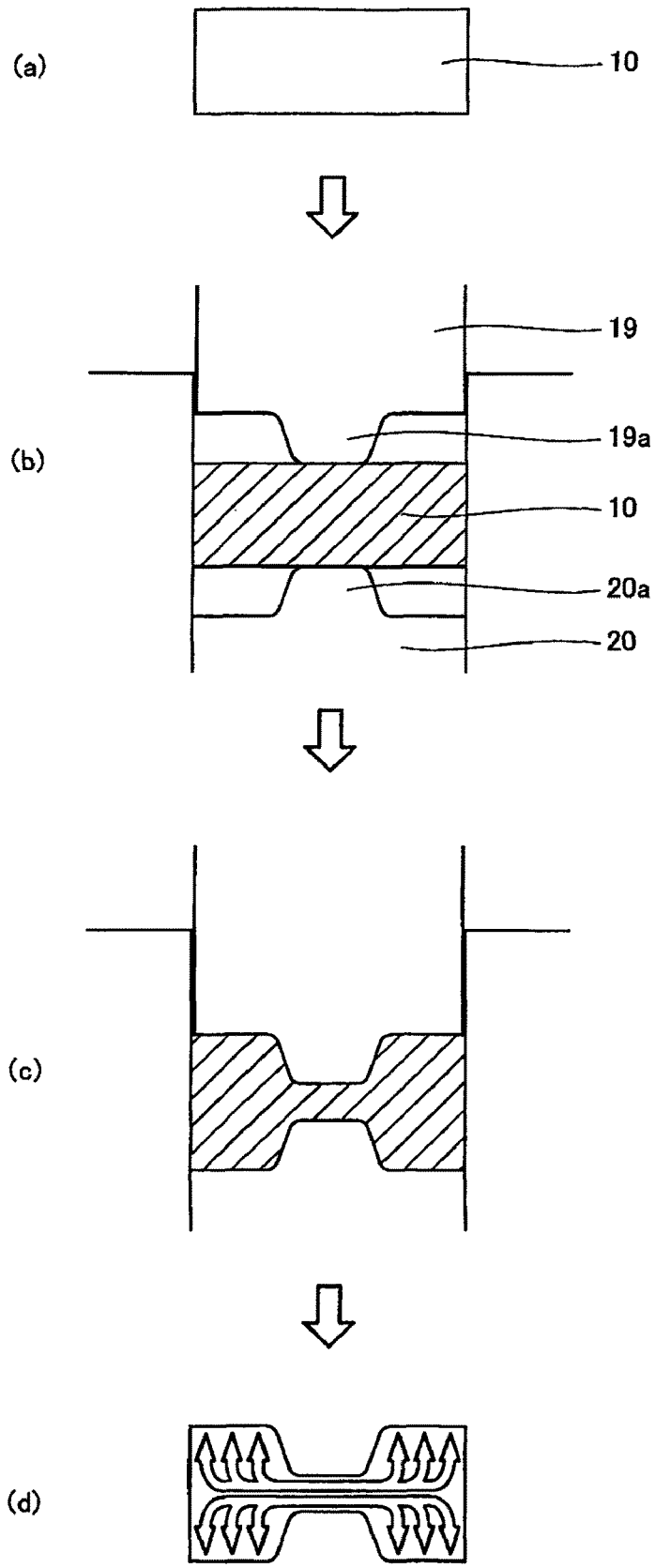
FIG. 9 shows another example of the method for plastic-deforming a central region of a material after completion of the new swaging method by forging.

FIG. 9 shows a method for forging the billet 10 from above and beneath by an upper punch 19 and a lower punch 20 after completion of the new swaging method. The upper punch 19 and the lower punch 20 respectively have protrusions 19*a* and 20*a* for forming a recess in the central region of the billet 10. The forged billet 10 therefore has a recess in both the upper and lower parts of the central region.

Figure 10:
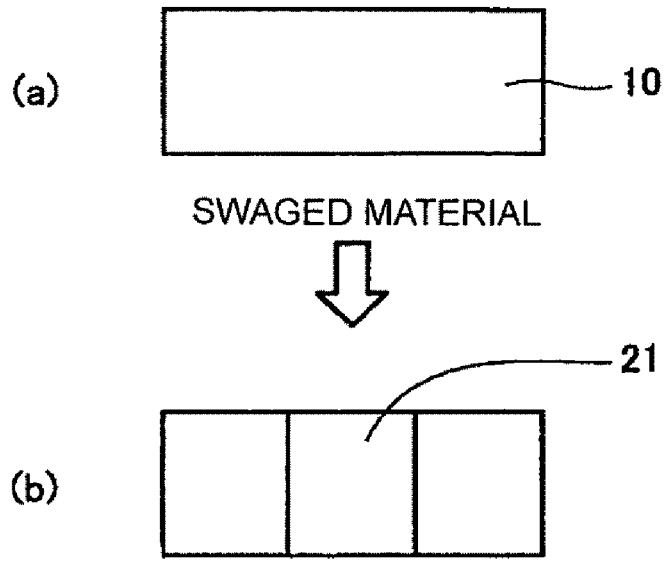
FIG. 10 shows an example of a method for removing a central region of a material after completion of the new swaging method by machining.

FIG. 10 shows a method for forming a central hole 21 in the middle by removing the central region of the billet 10 by machining after completion of the new swaging method. Since the central region having a low strength is removed in this method, approximately the whole region of the billet has an excellent strength.

In the new swaging method of FIG. 1, the radially outward plastic flow is gradually caused from one end toward the other end of the starting material. Accordingly, one end of the starting material tends to first expand to the outer periphery and the other end thereof tends to remain in the middle. Different kinds of metal or alloy materials can be bonded together by using this tendency.

Figure 11:
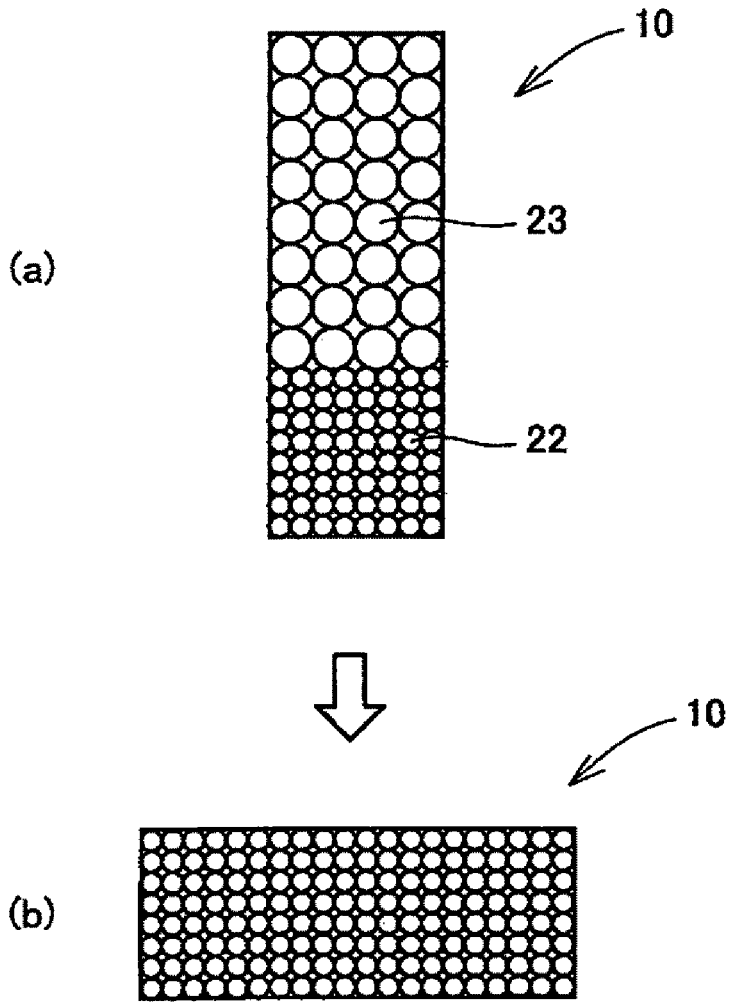
FIG. 11 illustrates an example of applying the new swaging method to a stacked material of two kinds of powder compacts.

In the method of FIG. 11, the material 10 is formed by a fine powder compact 22 disposed on the support member side, and a coarse powder compact 23 disposed on the press member side. When the new swaging method is performed on the material 10 having this arrangement, the coarse powder compact 23 plastically flows radially outward and has fine grains in an early stage. The material 10 is therefore formed by fine grains of an approximately uniform grain size in the final billet form. Note that, for example, a pulverized extruded material or atomized powder may be used as the fine grain powder compact 22.

Figure 12:
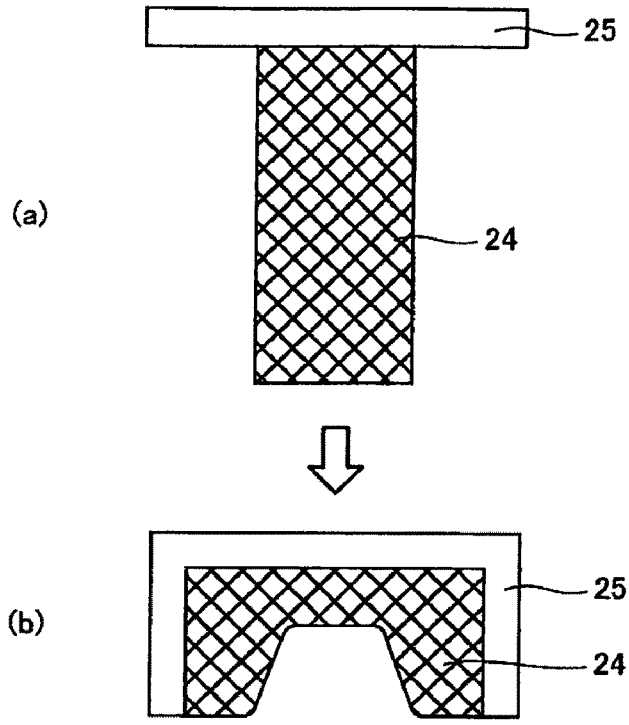
FIG. 12 illustrates an example of applying the new swaging method to a stacked material of a bar-shaped powder compact and a plate-shaped ingot.

FIG. 12 shows a method for performing the new swaging method with an ingot plate 25 being placed on a bar-shaped powder compact 24. The ingot plate 25 is made of a different material from that of the bar-shaped powder compact 24. In this method, the ingot plate 25 is shaped into a bowl-like form surrounding the upper end of the bar-shaped powder compact 24 in an early stage. The bar-shaped powder compact 24 then sequentially flows like a fountain along the inner surface of the bowl-shaped ingot plate 25. As a result, the ingot plate 25 and the powder compact 24 can be desirably bonded together.

Figure 13:
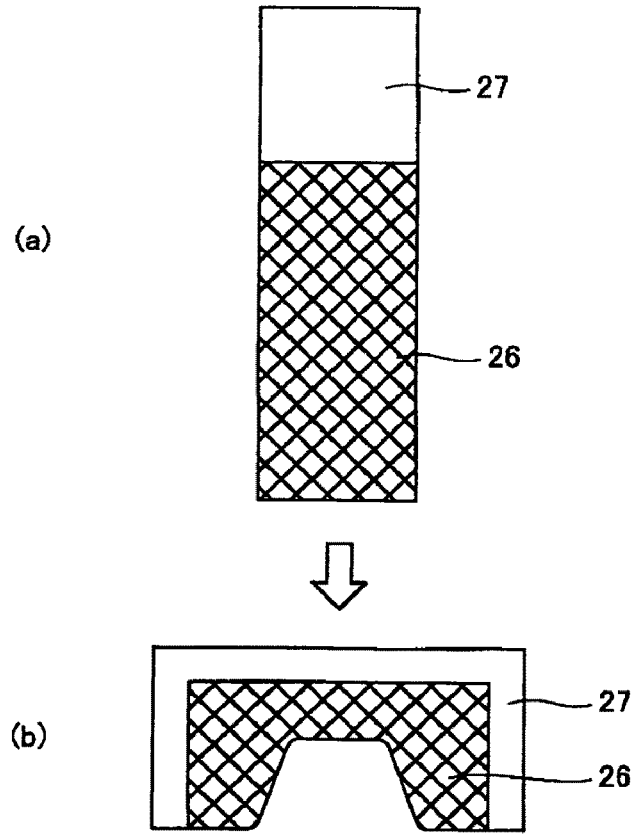
FIG. 13 illustrates an example of applying the new swaging method to a stacked material of a bar-shaped powder compact and a bar-shaped ingot.

FIG. 13 shows a method for performing the new swaging method with a bar-shaped ingot 27 being placed on a bar-shaped powder compact 26. The ingot 27 is made of a different material from that of the bar-shaped powder compact 26. In this method, the ingot 27 is shaped into a bowl-like form surrounding the upper end of the bar-shaped powder compact 26 in an early stage. The bar-shaped powder compact 26 then sequentially flows like a fountain along the inner surface of the bowl-shaped ingot 27. As a result, the ingot 27 and the powder compact 26 can be desirably bonded together.

First Example

A magnesium alloy (AZ31) ingot was used as a starting material. An extrusion process and the new swaging method of FIG. 1 were separately performed on the starting material and the respective results were compared.

Figure 14:
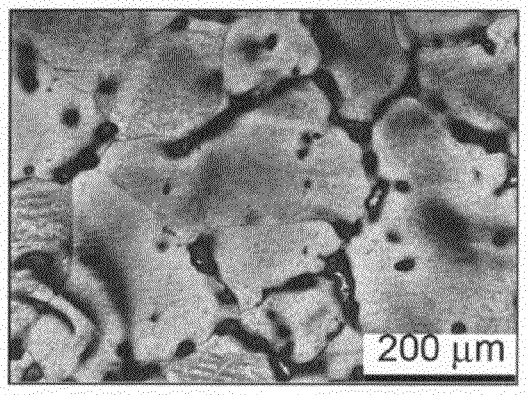
FIG. 14 shows images of a microstructure of a magnesium alloy (AZ31) ingot as a starting material.
Figure 14:
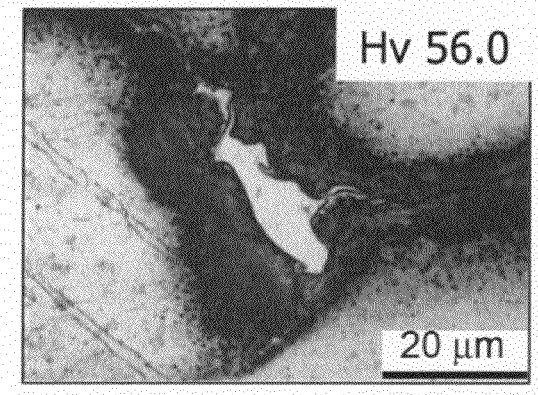

FIG. 14 shows a microstructure of the magnesium alloy ingot used as a starting material. The Vickers hardness Hv of the starting material was 56.0.

The extrusion process was performed under the following conditions:

extrusion ratio: r=37 (ϕ43→ϕ7)
heating temperature: 400° C.
extrusion speed: 18.5 mm/s.

Figure 15:
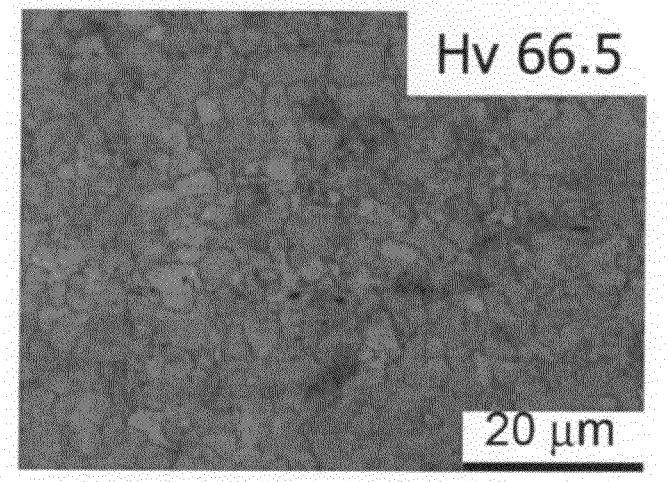
FIG. 15 is an image of a microstructure of an extruded material.

FIG. 15 shows a microstructure of an extruded material obtained under the above conditions. The extruded material had a grain size of 5 to 7 μm. The Vickers hardness Hv of the extruded material was 66.5.

The new swaging method was performed under the following conditions:

swaging ratio: 75% (ϕ25×L75→ϕ50×L18.5)
heating temperature: 450° C.
pressing speed: 5 mm/s.

Figure 17:
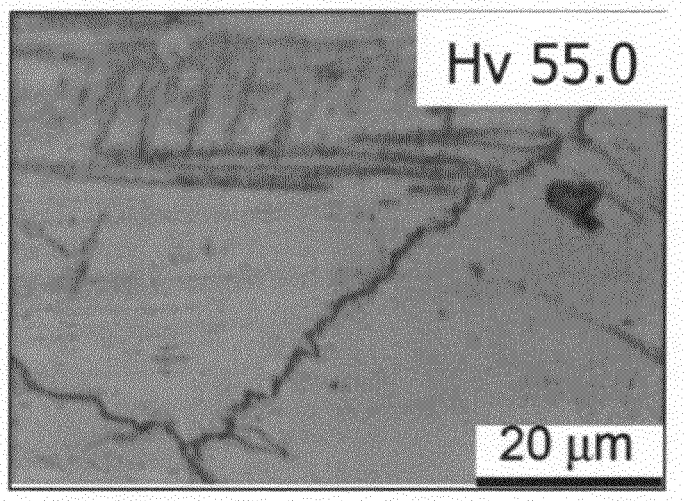
FIG. 17 is an image of a microstructure in the middle of a swaged material.
Figure 18:
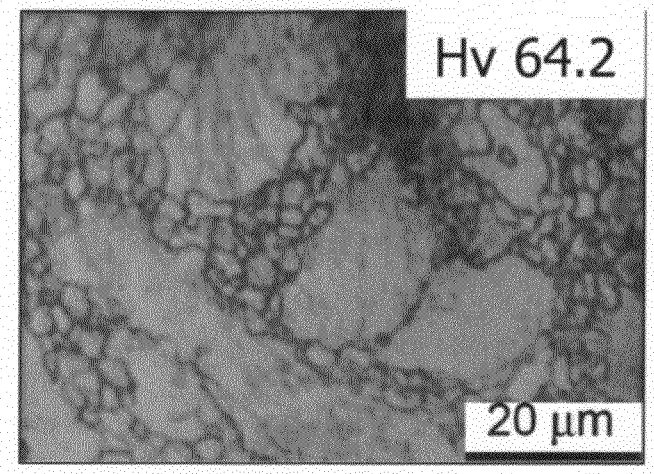
FIG. 18 is an image of a microstructure in the outer periphery of the swaged material.

FIG. 16 shows a macrostructure of a swaged material obtained under the above conditions. FIG. 17 shows a microstructure in the middle of the swaged material, and FIG. 18 shows a microstructure in the outer periphery of the swaged material. The swaged material has a grain size of 150 to 200 μm in the middle and a grain size of 5 to 30 μm in the outer periphery. The swaged material has a Vickers hardness Hv of 55.0 in the middle and a Vickers hardness Hv of 64.2 in the outer periphery.

Second Example

A magnesium alloy (AZ31) powder compact was used as a starting material. An extrusion process and the new swaging method of FIG. 1 were separately performed on the starting material and the respective results were compared.

Figure 19:
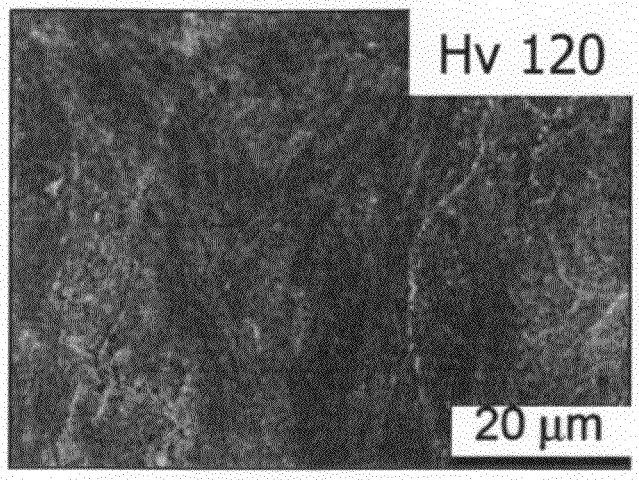
FIG. 19 is an image of a microstructure of a magnesium alloy (AZ31) powder compact as a starting material.

FIG. 19 shows a microstructure of the powder compact as a starting material. The powder compact has a grain size of 1 μm or less and a Vickers hardness Hv of 120.

The extrusion process was performed under the following conditions:

extrusion ratio: r=37 (ϕ43→ϕ7)

heating temperature: 450° C.

extrusion speed: 18.5 mm/s.

Figure 20:
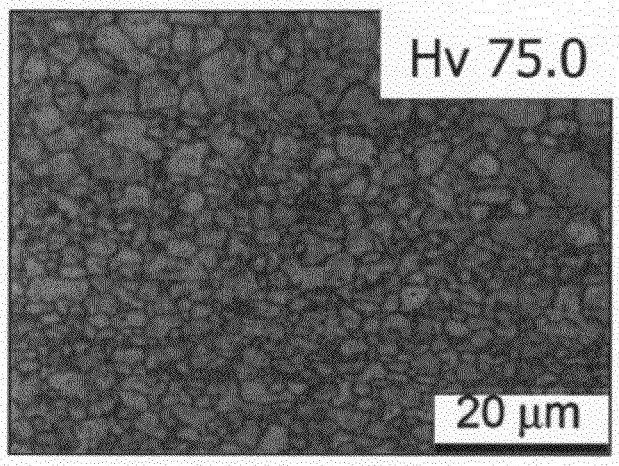
FIG. 20 is an image of a microstructure of a swaged material.

FIG. 20 shows a microstructure of an extruded material obtained under the above conditions. The extruded material had a grain size of 2 to 4 μm and a Vickers hardness Hv of 75.0.

The new swaging method was performed under the following conditions:

swaging ratio: 75% (ϕ25×L75→ϕ50×L18.5)

heating temperature: 450° C.

pressing speed: 5 mm/s.

Figure 22:
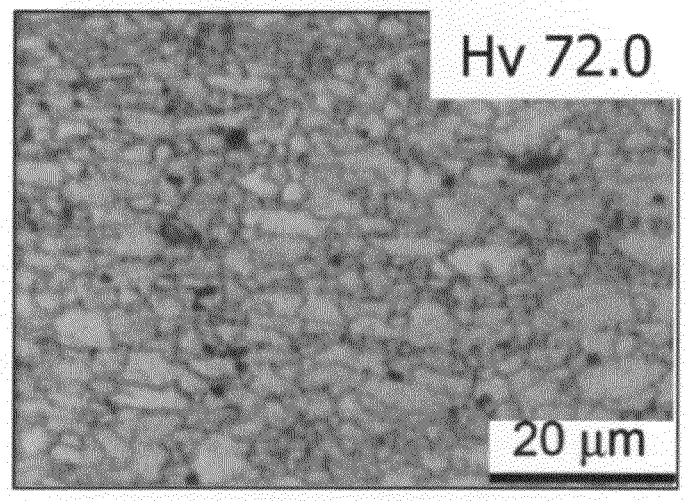
FIG. 22 is an image of a microstructure in the middle of the swaged material.
Figure 23:
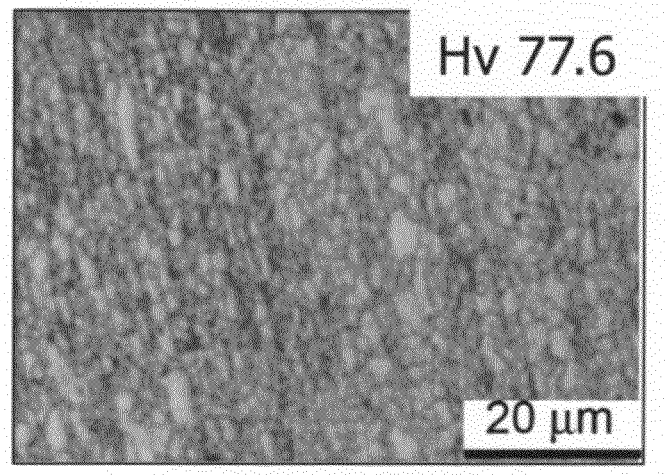
FIG. 23 is an image of a microstructure in the outer periphery of the swaged material.

FIG. 21 shows a macrostructure of a swaged material obtained under the above conditions. FIG. 22 shows a microstructure in the middle of the swaged material, and FIG. 23 shows a microstructure in the outer periphery of the swaged material. The swaged material has a grain size of 2 to 5 μm in the middle and a grain size of 2 to 4 μm in the outer periphery. The swaged material has a Vickers hardness Hv of 72.0 in the middle and a Vickers hardness Hv of 77.6 in the outer periphery.

Third Example

Table 1 shows comparison of the load applied to a magnesium alloy ingot and a magnesium alloy powder compact between the methods.

TABLE 1

| | Material form | Material diameter (mm) | Heating temperature (° C.) | Swaging ratio (%) | Extrusion ratio | Load (TON) During molding | Load (TON) Final pressure application | Load (TON) Back pressure |
|---|---|---|---|---|---|---|---|---|
| Swaged material | Ingot | ϕ50 | 450 | 75 | | 45.9 | 120 | 17.7 |
| | Powder compact | ϕ50 | 450 | 75 | | 48.1 | 120 | 17.7 |
| Extruded material | Ingot | ϕ7 | 400 | | 37 | 74.6 | | |
| | Ingot | ϕ7 | 450 | | 37 | 63.7 | | |
| | Powder compact | ϕ7 | 400 | | 37 | 71.6 | | |
| | Powder compact | ϕ7 | 450 | | 37 | 60.0 | | |

As can be seen from Table 1, a billet having a large diameter of ϕ50 can be easily produced with a relatively small load by the new swaging method. A load exceeding 3,000 tons is required to obtain an extruded material of ϕ50 under the same extrusion conditions as those shown in Table 1.

If the same characteristics (the solidification ratio, strength, and the like) as those of the extruded material can be obtained by the new swaging method, the load is about 120 tons, which is 1/25 of the load of the extrusion method. The new swaging method can thus implement significant reduction in load.

Although the embodiment of the present invention has been described with reference to the figures, the present invention is not limited to the illustrated embodiment. Various modifications and variations can be made to the above illustrated embodiment within the same scope as, or an equivalent scope to, the present invention.

INDUSTRIAL APPLICABILITY

The present invention can be advantageously used as a method and an apparatus for obtaining a high strength workpiece material having a fine crystal grain size while having a large diameter.

The invention claimed is:

1. A method for producing a high strength workpiece material, comprising the steps of:

placing a cylindrical mold having a vertically extending central space into a vertically extending central opening of a fixed mold in a vertically movable manner;

placing a small diameter, long metal or alloy starting material into a central space of the cylindrical mold;

vertically compressing both end faces of said small diameter, long starting material in said central space with a first press member and a support member, thereby causing one lengthwise end of said starting material to flow radially outward along an end face of said cylindrical mold to form an expanded part;

bringing a second press member into contact with a lengthwise end face of said expanded part so as to press said expanded part against the end face of said cylindrical mold; and increasing a distance between said second press member and the end face of said cylindrical mold while decreasing a distance between said first press member and said support member, thereby continuously causing the radially outward flow from one end to another end of said small diameter, long starting material to gradually increase a thickness of said expanded part and finally produce a large diameter, short billet having an outer diameter surface abutting against a wall surface of the central opening of the fixed mold.

2. The method according to claim 1, wherein said first press member and said second press member are integrally advanced and said cylindrical mold is retracted by an amount larger than the advancement amount of said press members.

3. The method according to claim 1, further comprising the step of, after increasing the thickness of said expanded part and producing said large diameter, short billet, vertically compressing only a central region of said billet to form a recess.

4. The method according to claim 1, further comprising the step of, before increasing the thickness of said expanded part, vertically compressing only a central region of said starting material to form a recess.

5. The method according to claim 1, further comprising the step of, after increasing the thickness of said expanded part and producing said large diameter, short billet, removing a central region of said billet by machining.

6. The method according to claim 1, wherein said starting material is an ingot.

7. The method according to claim 1, wherein said starting material is a powder compact.

8. The method according to claim 7, wherein said starting material includes a fine powder compact disposed on the support member side and a coarse powder compact disposed on the first press member side.

9. The method according to claim 1, wherein said starting material includes a first material which is disposed on the support member side and a second material which is of a different kind from that of said first material and disposed on the first press member side.

10. The method according to claim 1, wherein said starting material is a light alloy.

11. A high-strength workpiece material producing apparatus for plastic-working a small diameter, long metal or alloy starting material into a large diameter, short billet, comprising:

a fixed mold having a vertically extending central opening;

a cylindrical mold having a vertically extending central opening for receiving said small diameter, long starting material and being placed into the central opening of the fixed mold in a vertically movable manner;

a support member for supporting said starting material in said central opening from one end side;

a first press member for pressing said starting material in said central opening from another end side;

a second press member for pressing from another end side an expanded part of said starting material which is expanded radially outward along an end face of said cylindrical mold when said starting material is pressed by said first press member; and distance control means for increasing a distance between said second press member and said cylindrical mold while decreasing a distance between said first press member and said support member so as to finally produce said large-diameter, short billet having an outer diameter surface abutting against a wall surface of the central opening of the fixed mold.

12. The apparatus according to claim 11, wherein said first press member and said second press member are provided integrally.

13. The apparatus according to claim 11, wherein said first press member has a protrusion for forming a recess in a central region of said starting material.

* * * * *